US007717185B2

(12) United States Patent
Anderson et al.

(10) Patent No.: US 7,717,185 B2
(45) Date of Patent: May 18, 2010

(54) LOCK OPEN AND CONTROL SYSTEM ACCESS APPARATUS FOR A DOWNHOLE SAFETY VALVE

(75) Inventors: David Z. Anderson, Glenpool, OK (US); Darren E. Bane, Broken Arrow, OK (US); Allen P. Carney, Tulsa, OK (US)

(73) Assignee: Baker Hughes Incorporatd, Houston, TX (US)

( * ) Notice: Subject to any disclaimer, the term of this patent is extended or adjusted under 35 U.S.C. 154(b) by 0 days.

(21) Appl. No.: 12/172,658

(22) Filed: Jul. 14, 2008

(65) Prior Publication Data

US 2010/0006296 A1 Jan. 14, 2010

(51) Int. Cl.
*E21B 34/06* (2006.01)

(52) U.S. Cl. ..... 166/386; 166/332.8

(58) Field of Classification Search ..... 166/386, 166/332.4, 332.8

See application file for complete search history.

(56) References Cited

U.S. PATENT DOCUMENTS 3,786,865 A * 1/1974 Tausch et al. ..... 166/323
4,356,867 A * 11/1982 Carmody ..... 166/373
4,411,316 A 10/1983 Carmody
4,449,587 A * 5/1984 Rodenberger et al. ..... 166/323
4,542,792 A 9/1985 Akkerman
4,577,694 A 3/1986 Brakhage, Jr.
4,579,889 A 4/1986 Kaffen et al.
4,624,315 A 11/1986 Dickson et al.
4,967,845 A 11/1990 Shirk
5,249,630 A * 10/1993 Meaders et al. ..... 166/373
5,564,675 A 10/1996 Hill, Jr. et al.
6,059,041 A 5/2000 Scott
6,125,930 A 10/2000 Moyes
6,684,958 B2 2/2004 Williams et al.
6,902,006 B2 6/2005 Myerley et al.
7,137,452 B2 11/2006 McVicker
7,210,534 B2 5/2007 Hayter et al.

(Continued)

OTHER PUBLICATIONS

Bolding, Jeff L., et al., "Damaged Control Line Replacement Safety Valve Systen: Thru-Tubing", SPE 121407, Mar. 2009, 1-12.

(Continued)

*Primary Examiner*—David J Bagnell
*Assistant Examiner*—Elizabeth C Gottlieb
(74) *Attorney, Agent, or Firm*—Steve Rosenblatt

(57) ABSTRACT

A combination penetration tool for access to the control system of a subsurface safety valve also has a lockout for the flapper that operates by latching into a nipple profile near its upper end as a series of collet fingers pass through a sleeve that is held in the locked position on the valve housing. One or more dogs on the collet fingers line up with the flapper already pushed open by the advancing collet fingers to push the flapper further back. A second series of dogs get past the sleeve after moving through it. With a jar up force the second series of dogs overcomes a lock on the sleeve and shifts the sleeve to overlap the open flapper and allow the lock ring that moves with the sleeve to latch into the housing. The second series of dogs is sheared off but retained by the tool for removal from the well. The penetrator portion of the tool is a known device that preferably works by jarring up.

19 Claims, 3 Drawing Sheets

U.S. PATENT DOCUMENTS 7,409,996 B2 8/2008 Myerley et al.

OTHER PUBLICATIONS

Busch, J.M., et al., "Subsurface Safety Valves: Safety Asset or Safety Liability", Journal of Petroleum Technology, Oct. 1985, 1813-1818.

Gilbert, D.L., et al., "Releasable Fusible Lockopen Device Enhances Emergency Shutdown Capabilities", SPE 22805, Oct. 1991, 463-468.

* cited by examiner

LOCK OPEN AND CONTROL SYSTEM ACCESS APPARATUS FOR A DOWNHOLE SAFETY VALVE

FIELD OF THE INVENTION

The field of this invention is lock open devices for subsurface safety valves (SSSV) and related techniques for gaining access to the pressurized control system for subsequent operation of an inserted replacement.

BACKGROUND OF THE INVENTION

SSSVs are normally closed valves that prevent blowouts if the surface safety equipment fails. Conditions can arise where the SSSV fails to function for a variety of reasons. One solution to this situation has been to lock open the SSSV and to gain access into the pressurized control system that is used to move the flow tube to push the flapper into an open position against the force of a closure spring that urges the valve into a closed position. Thereafter, a replacement valve is delivered, normally on wireline, and latched into place such that the newly formed access to the control system of the original valve is now straddled by the replacement valve. This allows the original control system to be used to operate the replacement valve.

There have been several variations of lock open devices in the past. U.S. Pat. No. 4,577,694 assigned to Baker Hughes teaches the use of a flapper lock open tool (FLO) which delivers a band of spring steel to expand when retaining sleeves on the FLO tool are retracted. The tool latches inside the SSSV and with the flow tube in the flapper-closed position the band is released. This design offered the advantages of the lockout device not being integral to the SSSV. Instead it was only introduced when needed through a wireline. Another advantage was that the release of the band did no damage to the SSSV or the FLO tool. The band expanded into a recessed area so as to allow full-bore through-tubing access. The flow tube did not have to be shifted so that no spring forces acting on the flow tube had to be overcome to actuate the FLO tool. Subsequently, when the SSSV was retrieved to the surface, the band was easily removed by hand without special tools. The FLO tool had safety features to prevent premature release or incorrect placement. The FLO tool did not require fluid communication with the control system, as its purpose was solely flapper lock out.

The FLO tool did have some disadvantages. One was that the band could become dislodged under high gas flow rates. The tool was complicated and expensive to manufacture. The expanding ring presented design challenges and required stocking a large variety to accommodate different conditions. The running method required two wireline trips with jar-down/jar-up activation.

U.S. Pat. No. 4,579,889 assigned to Camco, now Schlumberger, required latching in the SSSV and stroking the flow tube down to the valve open position. The flow tube would then be outwardly indented in the valve open position so that the indentations would engage a downwardly oriented shoulder to prevent the flow tube from moving back to the valve closed position. This design had some of the advantages of the Baker Hughes FLO design and could accomplish the locking open with a single wireline trip. The disadvantages were that the flow tube was permanently damaged and that the flow tube had to be forced against a closure spring force before being dimpled to hold that position. This made disassembly of the SSSV with the flow tube under spring pressure a potentially dangerous proposition when the valve was later brought to the surface.

U.S. Pat. No. 5,564,675 assigned to Camco, now Schlumberger, also involved forcibly pushing the flow tube against the spring to get the flapper into the open position. In fact, the flow tube was over-stroked to push the actuator piston out of its bore in the pressurized control system, at which point the piston would have a portion splay out preventing its re-entry into the bore, thereby holding the flow tube in the flapper open position. This design had the safety issues of disassembly at the surface where the flow tube was under a considerable spring force. Additionally, fluid communication into the control system was not an option when locking open using this tool.

U.S. Pat. No. 6,059,041 assigned to Halliburton uses a tool that forces the flow tube down to get the flapper in the open position. It then releases a band above the flow tube that lodges on a downwardly oriented shoulder to hold the flapper open. This system has the risk of a flow tube under a spring force causing injury when later disassembled at the surface. This tool is fluid activated and must overcome the spring force to get the flow tube to the flapper open position. Finally, the tool is fluid pressure actuated, which will require a long fluid column to eventually communicate with the formation, a particular disadvantage in gas wells. Also of interest in the area of lock open devices for SSSVs are U.S. Pat. Nos. 4,624,315; 4,967,845 and 6,125,930 (featuring collet fingers on the end of the flow tube that engage a groove in the SSSV body). More recently a combination tool has been disclosed that penetrates into an existing control system while locking the flapper open with a jarring force that moves a flapper base when the flapper is wide open so that the flapper becomes trapped in the housing in a retaining groove. This is described in U.S. Pat. No. 6,902,006. It has a fairly complex system for locating it in the proper position and as a result is expensive to manufacture.

The present invention focuses on a one trip operation to penetrate and lock the flapper open. It doesn't require flow tube movement or deformation or shifting a base for a flapper to obtain the locked open position. It doesn't deliver a sleeve to the flapper from the surface. Rather, in the preferred embodiment, the safety valve is put in service with the sleeve locked in position. A tool lands and is locked in a nipple adapter at the upper end. The lower end passes through the sleeve and no-goes below it. A jar up force unlatches the sleeve and shifts it under the flapper whereupon its position is secured. The no-go shoulder also moves the sleeve and is sheared off and retained to the tool for removal from the hole. Centralizers are provided to the sleeve circumferentially in alignment with the bore in the safety valve so that passing tools or an insert safety valve can be installed without interference. Those skilled in the art will more readily appreciate the full scope of the invention from the more detailed description of the preferred embodiment that appears below with its associated drawings while recognizing that the full scope of the invention is to be determined by the appended claims.

SUMMARY OF THE INVENTION

A combination penetration tool for access to the control system of a subsurface safety valve also has a lockout for the flapper that operates by latching into a nipple profile near its upper end as a series of collet fingers pass through a sleeve that is held in the locked position on the valve housing. One or more dogs on the collet fingers line up with the flapper already pushed open by the advancing collet fingers to push the flapper further back. A second series of dogs get past the sleeve after moving through it. With a jar up force the second series of dogs overcomes a lock on the sleeve and shifts the sleeve to overlap the open flapper and allow the lock ring that moves with the sleeve to latch into the housing. The second series of dogs is sheared off but retained by the tool for removal from the well. The penetrator portion of the tool is a known device that preferably works by jarring up.

DETAILED DESCRIPTION OF THE PREFERRED EMBODIMENT

Figure 5:
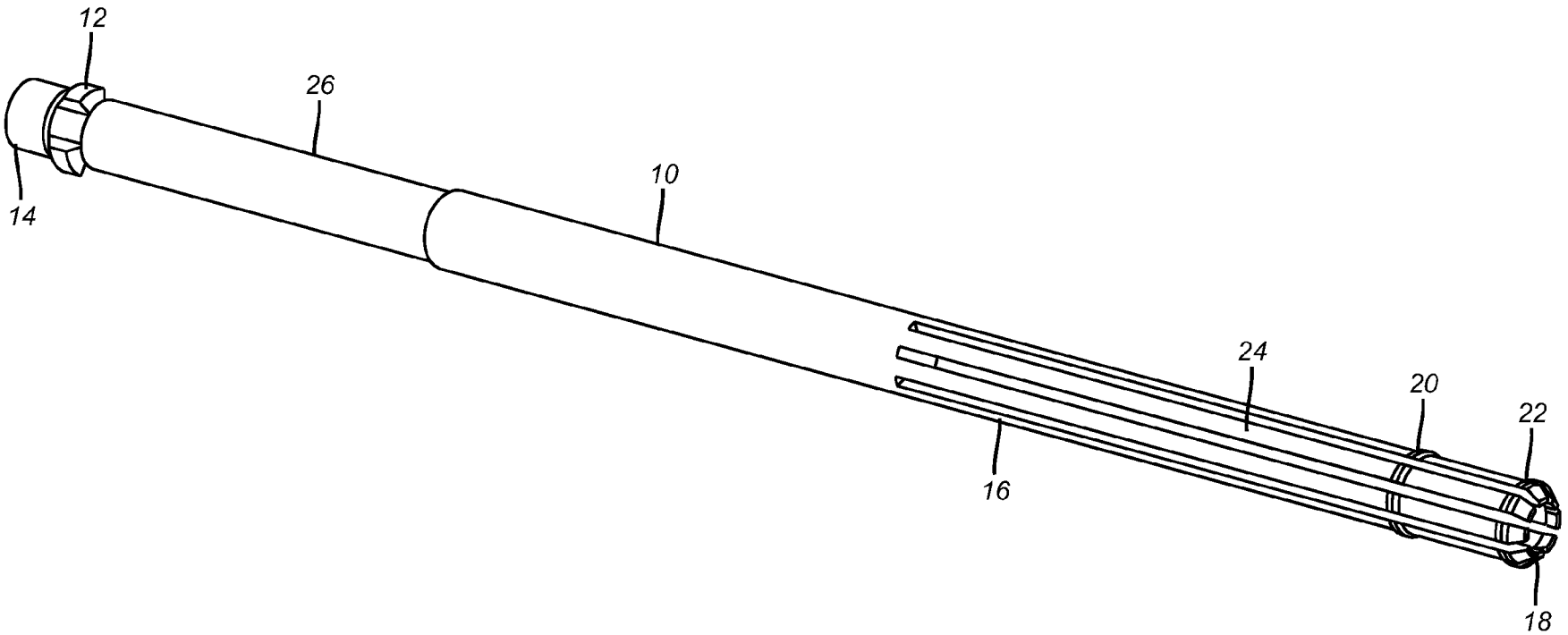
FIG. 5 is a perspective view of the tool exterior.

FIG. 5 shows the overall tool 10 that has support dogs 12 near the upper end 14 and a series of collet fingers 16 at the lower end 18. The fingers 16 have a series of upper dogs 20 that extend circumferentially above a series of lower dogs 22 that also extend circumferentially on the exterior faces 24 of the fingers 16. A penetration tool of a type known in the art such as described in U.S. Pat. No. 6,902,006 is shown schematically as 26 and the description of the detailed operation of such a tool is incorporated by reference from U.S. Pat. No. 6,902,006 as if fully set forth herein.

Figure 1:
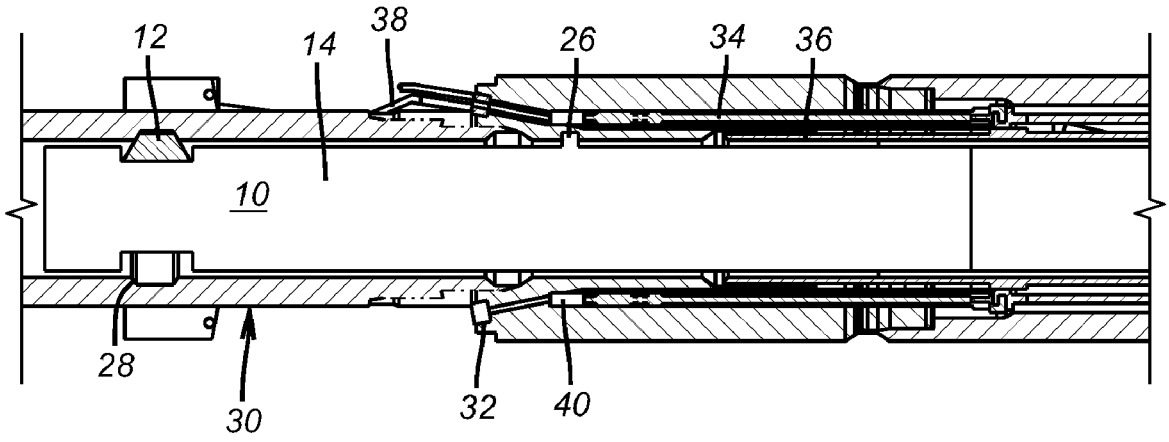
FIG. 1 is a section view of the upper end of the tool latched into the nipple adapter.

FIG. 1 shows the upper end 14 of the tool 10 with dogs 12 engaged into respective grooves 28 in the valve housing 30. Connection 32 leads to an operating piston 34 that moves the flow tube 36 when pressure is applied from the surface to a control line such as 38. A chamber 40 above the piston 34 is where the penetration tool 26 goes through the wall of the housing 30.

Figure 2:
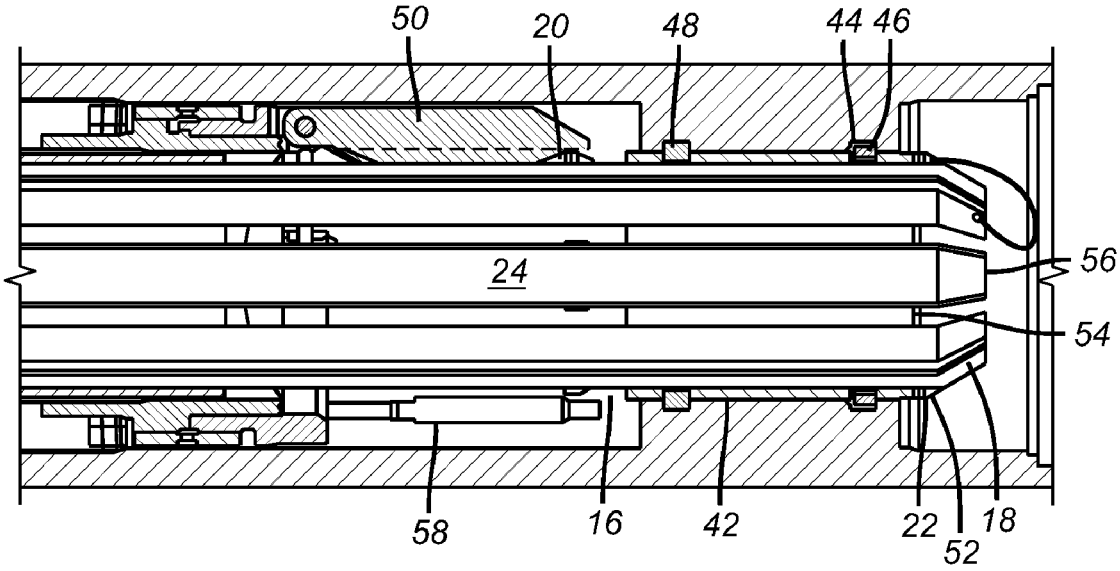
FIG. 2 shows the sliding sleeve engaged just before jarring to the lock open position.
Figure 3:
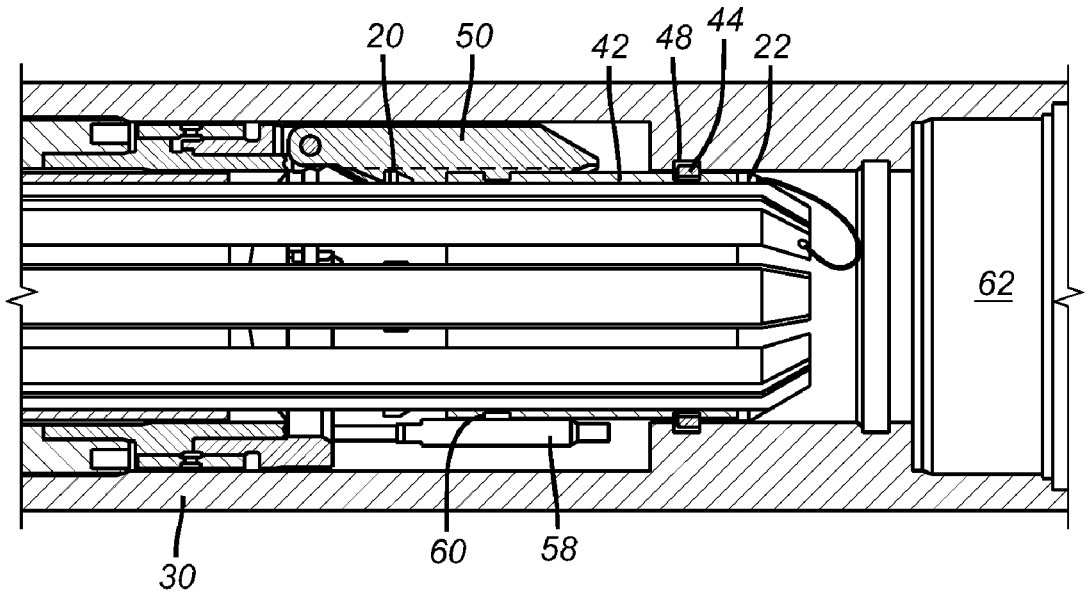
FIG. 3 shows the shifted position of the sleeve so that the flapper is locked open.

FIG. 2 shows the tool 10 fully inserted and the components near its lower end 18. A sleeve 42 is initially retained to groove 44 by a snap ring 46. The upper end of the snap ring 46 and the groove 44 are beveled so that the sleeve 42 can be urged uphole by collapsing the snap ring 46 sufficiently around the sleeve 42 so that both can move in tandem until the snap ring 46 aligns with groove 48 on the housing 30. Collet fingers 16 and their outer surfaces 24 are shown in more detail in FIG. 2 than in FIG. 5. Upper collet dogs 20 wind up propping up the flapper 50 when dogs 12 are engaged in grooves 28. As a result the flapper is propped back far enough so that when the sleeve 42 is pushed up the sleeve 42 will ride under the flapper 50 as shown in FIG. 3. The lower dogs 22 in FIG. 2 hook under shoulder 52 after springing radially out and under the lower end 54 of the sleeve 42 to resist uphole movement. The lower ends 56 of the fingers 16 are turned in so as not to catch on grooves in the housing 30 or pipe joint in the tubing string through which it is run in. One or more centralizers 58 will ultimately centralize the sleeve 42 after is shifted.

Figure 4:
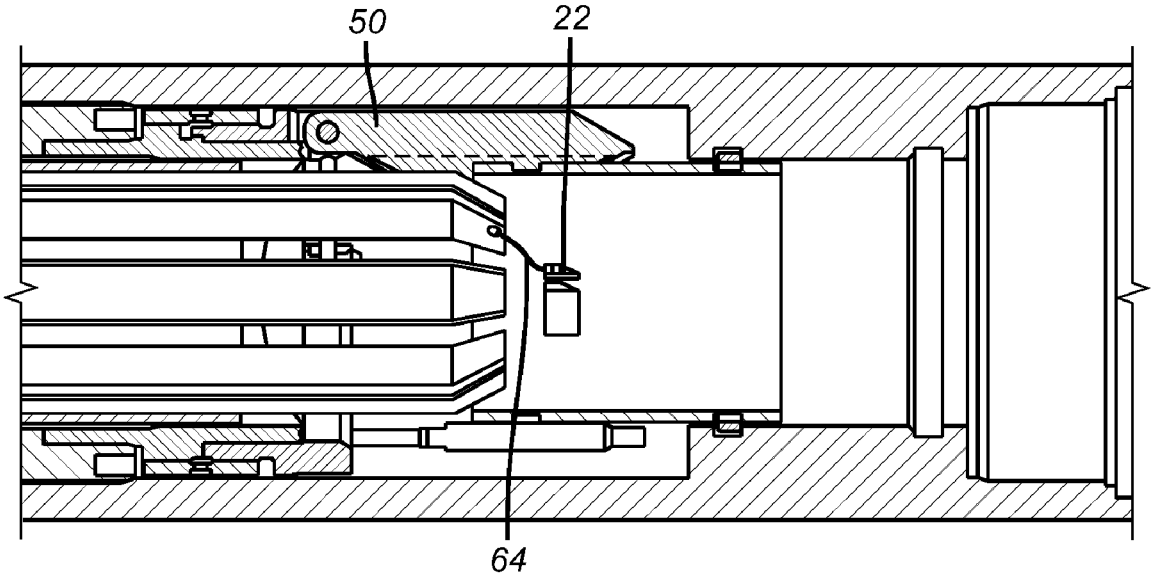
FIG. 4 shows the shearing of the dogs that moved the sleeve and how they are retained for removal from the well.

FIG. 3 shows the lower dogs 22 taking the sleeve 42 uphole to the point where snap ring 46 snaps into groove 48 and centralizers 58 engage an outer groove 60 on the sleeve 42 to align it with the flow path 62 in housing 30. Further pulling or jarring up on the tool 10 beyond the FIG. 3 position will shear off lower dogs 22 that are each retained by a wire 64 so that they don't fall downhole and can be removed with the tool 10 as shown in FIG. 4. The flapper 50 is now locked open.

Those skilled in the art can appreciate that the sleeve to lock out the flapper is already in the housing when it is deployed downhole and is secured in position until the tool 10 is in position to shift the sleeve. The dogs 22 can be matched to their landing shoulder 52 to reduce the chance of other tools moving through from unintentionally engaging the sleeve 42 and dislodging it prematurely. The flapper 50 is pushed back by dogs 20 to give the sleeve room to move into position without hitting the held open flapper. The dogs 22 that get sheared off are retained to avoid damage to other downhole equipment.

The above description is illustrative of the preferred embodiment and many modifications may be made by those skilled in the art without departing from the invention whose scope is to be determined from the literal and equivalent scope of the claims below:

We claim:

1. A method for locking open a flapper in a subsurface safety valve located downhole, comprising:

inserting a tool through a flow tube in a valve housing to push the flapper to an open position, said flow tube movably engaging the flapper for normal flapper operation;

landing said tool on a support fixedly mounted on said housing;

engaging a sleeve mounted to said valve housing with a tab on said tool that is positioned in contact with a lower end of said sleeve when said tool is landed on said support;

repositioning said sleeve to overlay said flapper in a manner that prevents subsequent sleeve movement which keeps said flapper from returning to the closed position; and removing the tool.

2. The method of claim 1, comprising:

initially securing said sleeve in said housing;

using said tool to release said sleeve for initial movement.

3. The method of claim 2, comprising:

re-securing said sleeve to said housing after said initial movement thereof.

4. The method of claim 3, comprising:

centralizing said sleeve after said movement for alignment with a passage through said housing.

5. The method of claim 2, comprising:

providing at least one first dog on said tool to hold open said flapper out of the way of said sleeve during said initial movement.

6. The method of claim 5, comprising:

providing at least one second dog on said tool to act as a no go during insertion of said tool.

7. The method of claim 1, comprising:

providing a locating groove in said housing and at least one locking dog in said tool for securely positioning said tool with respect to said sleeve before said repositioning;

providing a penetrating device on said tool to create an opening from a passage in said housing to a control system that operates said flow tube in the same trip as said repositioning of said sleeve.

8. A method for locking open a flapper in a subsurface safety valve located downhole, comprising:

inserting a tool through a flow tube in a valve housing to push the flapper to an open position, said flow tube movably engaging the flapper for normal flapper operation;

initially securing said sleeve in said housing;

repositioning said sleeve adjacent the flapper in a manner that prevents subsequent sleeve movement which keeps said flapper from returning to the closed position;

engaging a sleeve mounted to said valve housing with said tool;

using said tool to release said sleeve for initial movement;

providing at least one first dog on said tool to hold open said flapper out of the way of said sleeve during said initial movement;

providing at least one second dog on said tool to act as a no go during insertion of said tool;

engaging an end of said sleeve with said second dog when said second dog is in a no go position;

moving said sleeve with said second dog;

re-securing said sleeve to said housing after said initial movement thereof;

removing the tool.

9. A method for locking open a flapper in a subsurface safety valve located downhole, comprising:

inserting a tool through a flow tube in a valve housing to push the flapper to an open position;

engaging a sleeve mounted to said valve housing with said tool;

repositioning said sleeve adjacent the flapper in a manner that prevents it from returning to the closed position; and removing the tool;

initially securing said sleeve in said housing;

using said tool to release said sleeve for initial movement;

providing at least one first dog on said tool to hold open said flapper out of the way of said sleeve during said initial movement;

providing at least one second dog on said tool to act as a no go during insertion of said tool;

engaging an end of said sleeve with said second dog when said second dog is in a no go position;

moving said sleeve with said second dog;

re-securing said sleeve to said housing after said initial movement thereof;

separating said second dog from said tool as a result of applied force to said tool after said re-securing;

retaining said separated second dog to said tool after said separating for removal of both in tandem from said housing.

10. The method of claim 9, comprising:

locating said first dog above said second dog on at least one flexible collet;

providing a lower end on said collet that is bent inwardly toward a longitudinal axis of said housing;

using a snap ring to releasably secure said sleeve prior to said initial movement.

11. A subsurface safety valve assembly for downhole use, comprising:

a housing further comprising a flow tube whose movement operates a flapper between an open and a closed position;

a flapper lock open sleeve having an end that can be grabbed by a tool directly supported by said housing to shift said sleeve and mounted in said housing in a first position when the valve is installed downhole where it will not interfere with the open and closed positions of said flapper, said sleeve movable relative to said flapper to a second and final position overlying said flapper to retain said flapper locked in said open position.

12. The assembly of claim 11, wherein:

said sleeve is releasably retained to said housing in said first position.

13. The assembly of claim 12, wherein:

said sleeve is centralized with a passage through said housing in its second position;

said sleeve is retained by a snap ring.

14. The assembly of claim 11, further comprising:

said tool comprising at least a first dog to push said flapper out of the path of said sleeve when advanced by said tool.

15. A subsurface safety valve assembly for downhole use, comprising:

a housing further comprising a flow tube whose movement operates a flapper between an open and a closed position;

a flapper lock open sleeve mounted in said housing in a first position when the valve is installed downhole where it will not interfere with the open and closed positions of said flapper, said sleeve movable to a second and final position to retain said flapper locked in said open position;

a tool insertable through said sleeve to engage said sleeve for movement;

said tool comprising at least a first dog to push said flapper out of the path of said sleeve when advanced by said tool;

said tool comprising at least one second dog to engage said sleeve to move it toward said second position;

said second dog located below said first dog on at least one flexible collet.

16. The assembly of claim 15, wherein:

said second dog acts as a no go for said tool.

17. The assembly of claim 16, wherein:

said housing comprises a locating groove and said tool comprises a locating dog to engage said locating groove when said second dog no goes on said housing.

18. A subsurface safety valve assembly for downhole use, comprising:

a housing further comprising a flow tube whose movement operates a flapper between an open and a closed position;

a flapper lock open sleeve mounted in said housing in a first position when the valve is installed downhole where it will not interfere with the open and closed positions of said flapper, said sleeve movable to a second position to retain said flapper locked in said open position;

a tool insertable through said sleeve to engage said sleeve for movement;

said tool comprising at least a first dog to push said flapper out of the path of said sleeve when advanced by said tool;

said tool comprising at least one second dog to engage said sleeve to move it toward said second position;

said second dog located below said first dog on at least one flexible collet;

said second dog moving said sleeve to said second position where said sleeve is locked, said second dog separating from said collet but continuing to be retained by said collet as said tool is removed through said flow tube.

19. The assembly of claim 18, wherein:

said tool further comprises a penetrating tool to allow penetrating into a control system for the subsurface safety valve in the same trip as locking open said flapper.

* * * * *